United States Patent [19]

Kron et al.

[11] Patent Number: 4,772,428

[45] Date of Patent: Sep. 20, 1988

[54] IMPREGNATING AGENTS AND THE USE THEREOF

[75] Inventors: Rudolf Kron, Leverkusen; Alfons Klein, Düsseldorf; Karlfried Wedemeyer, Cologne, all of Fed. Rep. of Germany

[73] Assignee: Bayer Aktiengesellschaft, Leverkusen, Fed. Rep. of Germany

[21] Appl. No.: 46,482

[22] Filed: May 4, 1987

[30] Foreign Application Priority Data

May 21, 1986 [DE] Fed. Rep. of Germany ..... 3617062

[51] Int. Cl.[4] ..... H01B 3/22

[52] U.S. Cl. ..... 252/578; 361/315; 585/6.3

[58] Field of Search ..... 252/578

[56] References Cited

U.S. PATENT DOCUMENTS 3,673,093 6/1972 Rocchi ..... 252/578

FOREIGN PATENT DOCUMENTS 63297 4/1982 European Pat. Off. .

51-72000 6/1976 Japan ..... 252/578

2106529 4/1983 United Kingdom .

*Primary Examiner*—Robert Wax

*Attorney, Agent, or Firm*—Sprung Horn Kramer & Woods

[57] ABSTRACT

Liquid compositions, having dielectric properties, which contain mixtures of ditolylether isomers and alkylbenzenes.

15 Claims, No Drawings

IMPREGNATING AGENTS AND THE USE THEREOF

The invention relates to new liquid compositions, having advantageous dielectric properties, and the use thereof as impregnating agents in electrical devices.

Mixtures of ditolyl ether isomers are described as impregnating agents for electrical devices in EP-B-0,063,297. These ditolyl ether isomeric mixtures are distinguished by their excellent dielectric properties, high dielectric constants and low dielectric losses. However, they have the disadvantage that their dielectric loss factors are strongly influenced by impurities. This sensitivity towards impurities has been found to be particularly disadvantageous in conventional paper- and mixed-dielectric power capacities, but above all in modern low-loss all-film capacitors; impregnating agents having extremely low dielectric loss factors are required for these all-film capacitors.

It has now been found that the sensitivity towards impurities of the dielectrics based on mixtures of ditolyl ether isomers can be reduced when a certain amount of alkylbenzenes is added to the ditolyl ether isomeric mixtures.

Surprisingly, it has been found that the loss factors of alkylbenzene-containing mixtures of ditolyl ether isomers are well below the values which are to be expected from the proportion of the components in the mixture and the loss factors of the components.

Alkylbenzenes and their properties as insulating liquids are known (see, for example, Ölbuch, 6th edition, 1983, part 2, Verlags- und Wirthschaftsgesellschaft der Elektrizitatswerke m.b.h., pages 75–76). However, they can only be used in those electrical devices whose dielectrics are subjected to low electrical field strengths. For electrical devices whose dielectrics are subjected to high electrical field strengths, for example low-loss all-film capacitors, they are not suitable due to their inadequate gas absorption properties and the low discharge inception voltage and discharge extinction voltage (see the company publication "Evaluation of capacitor impregnants" Scientific Paper 84-1B 5-CAPDI-P 2, 18th July 1984, Westinghouse Company, page 5).

Taking these known properties of alkylbenzenes into account, it was surprising that their addition to mixtures of ditolyl ether isomers only caused on overproportional improvement of the loss factors, but no corresponding worsening of the excellent dielectric properties of the ditolyl ether isomeric mixtures.

The advantageous action of the addition, according to the invention, of alkylbenzene on the dielectric properties of the ditolyl ether isomeric mixtures was also not suggested by the ditolyl ether-containing electro-insulating oils, based on mineral oils, described in EP-A-0,170,054, since the improvement of the inadequate gas absorption capability of mineral oils by addition of ditolyl ethers, for example, is described in this EP-A-0,170,054. The mineral oil/ditolyl ether mixtures obtained in this fashion differ fundamentally from the liquid compositions according to the invention both in their composition and in their electrical properties.

The invention thus relates to new liquid compositions, having dielectric properties, based on mixtures of ditolyl ether isomers, which are characterized in that they contain mixtures of ditolyl ether isomers and alkylbenzenes.

The proportions of the mixture of ditolyl ether isomers and the alkylbenzenes in the compositions according to the invention may vary within broad limits; in general it has proven successful for the liquid compositions according to the invention to contain 50 to 95% by weight, preferably 60 to 85% by weight, of ditolyl ether isomeric mixture and 5 to 50% by weight of alkylbenzenes, preferably 15 to 40% by weight of alkylbenzenes.

The liquid compositions according to the invention may additionally contain stabilizing additives, particularly acid acceptors and oxidation inhibitors.

Epoxy compounds are used preferably as acid acceptors. The following epoxy compounds may be mentioned as examples: 1,2-epoxy-3-phenoxypropane, bis-(3,4-epoxy-6-methylcyclohexyl-methyl) adipate, 1-epoxy-ethyl-3,4-epoxy-cyclohexane, 3,4-epoxy-cyclohexane, 3,4-epoxycyclohexylmethyl, 3,4-epoxycyclohexane-carboxylate, 3,4-epoxy-6-methylcyclohexyl-methyl, 3,4-epoxy-6-methylcyclohexanecarboxylate and 2,2-bis-(4-hydroxyphenyl)-propanediglycidyl ether.

In general, the epoxy compounds are employed in amounts from 0.1 to 5% by weight, preferably 0.3 to 1% by weight, relative to the total weight of the liquid composition.

Aromatic carbocyclic compounds having 1 or 2 hydroxyl groups are preferably used as oxidation inhibitors. The following oxidation inhibitors may be mentioned as examples: 2,6-di-tert.-butyl-4-methylphenol, di-tert.-amyl-hydroquinone, 2,2-bis-(4-hydroxyphenyl)-propane and 4,4'-butylidene-bis-(6-tert.-butyl-m-cresol). 2,6-Di-tert.-butyl-4-methyl-phenol is preferably used as oxidation inhibitor in the liquid compositions according to the invention.

In general, the oxidation inhibitors are employed in amounts from 0.05 to 2.0% by weight, preferably 0.1 to 1.0% by weight, relative to the total weight of the liquid composition.

Preferred liquid compositions according to the invention preferably contain 90 to 110 parts by weight, particularly preferably 95 to 100 parts by weight, of the ditolyl ether/alkylbenzene mixture according to the invention, 0.05 to 2.0, particularly preferably 0.1 to 1.0, parts by weight of acid acceptor and 0.05 to 2.0, particularly preferably 0.1 to 1.0, parts by weight of oxidation inhibitor.

The compositions according to the invention are prepared by mixing the components.

The mixtures of ditolyl ether isomers on which the liquid compositions according to the invention are based and the preparation thereof are known and described, for example, in EP-B-0,063,297. Mixtures of ditolyl ether isomers as are produced during the hydrolysis of chlorotoluenes (Ing. Eng. Chem. 38, (1946), pages 254–261) are particularly preferably used.

The alkylbenzenes to be used according to the invention as an additive to the ditolyl ether isomeric mixtures are likewise known and are available in largescale industrial quantities. The alkyl radicals of the alkylbenzenes to be used according to the invention preferably contain 8 to 16, particularly preferably 10 to 14, carbon atoms. The alkylbenzenes may be employed in the form of pure compounds or in the form of mixtures of homologs. Thus, for example, dodecylbenzene, which is marketed under the trade name "Marlican" and which is very well suited for the use according to the invention, has the following composition: 4 to 6% by weight of $C_{10}$-alkylbenzene, 43 to 49% by weight of $C_{11}$-alkylbenzene, 36 to 40% by weight of $C_{12}$-alkylbenzene, 10 to 13% by weight of $C_{13}$-alkylbenzene and <1% by weight of $C_{14}$-alkylbenzene.

The invention furthermore relates to the use of the liquid compositions according to the invention as liquid dielectrics, particularly as impregnating agents for electrical devices. Capacitors and transformers, in particular, may be mentioned as electrical devices, particularly the capacitors which are constructed from multi-layer paper and aluminium foil, from metallized paper, from an optionally metallized plastic foil, for example from polypropylene, polycarbonate or polyterephthalates, or a mixed dielectric, for example of paper, plastic and aluminium foil or of metallized paper and plastic film. The impregnating agents according to the invention are preferably employed for capacitors which contain a plastic foil as solid dielectric, i.e. in so-called all-film capacitors.

The liquid compositions, according to the invention, having dielectrical properties can easily be biologically degraded and thus do not pollute the environment. Compared to the ditolyl ether isomeric mixtures described in EP-B-0,063,297, they have the advantage of considerably lower dielectric loss factors. This leads, for example, to a marked simplification in the production of capacitors. As a result of the lower sensitivity towards impurities which unavoidably get into the impregnating liquid due to contact of the impregnating liquid with parts of the impregnating plant and with solid capacitor components during the production of the capacitors, markedly lower loss performances are achieved in the finished capacitors.

As a result of their excellent dielectric values and their low dielectric loss factors, the liquid compositions according to the invention are particularly suitable for all-film power capacitors.

EXAMPLE 1

Preparation of the liquid compositions according to the invention:

Liquid composition I:

80% by weight of the mixture of ditolyl ether isomers (component A) of the composition specified below and 20% by weight of $C_{10}$–$C_{14}$-alkylbenzene (component B) of the composition likewise specified below are mixed intimately with one another at room temperature.

Liquid composition II:

60% by weight of the mixture of ditolyl ether isomers (component A) of the composition specified below and 40% by weight of $C_{10}$–$C_{14}$-alkylbenzene (component B) of the composition likewise specified below are mixed intimately with one another at room temperature.

Composition of component A:

| | |
|---|---|
| Unknown compound | 0.8% by weight |
| 2,2'-dimethyldiphenyl ether | 5.1% by weight |
| 2,3'-dimethyldiphenyl ether | 26.9% by weight |
| 2,4'-dimethyldiphenyl ether | 11.6% by weight |
| 3,3'-dimethyldiphenyl ether | 26.9% by weight |
| 3,4'-dimethyldiphenyl ether | 23.5% by weight |
| 4,4'-dimethyldiphenyl ether | 5.2% by weight |

Composition of component B:

| | |
|---|---|
| $C_{10}$-alkylbenzenes | 4–6% by weight |
| $C_{11}$-alkylbenzenes | 43–49% by weight |
| $C_{12}$-alkylbenzenes | 36–40% by weight |
| $C_{13}$-alkylbenzenes | 10–13% by weight |
| $C_{14}$-alkylbenzenes | <1% by weight |

Of identical all-film capacitors, one group was impregnated with the liquid composition I, a second with the identical quantity of liquid composition II and the third with the identical quantity of component A. The dielectric loss factors of the capacitors were subsequently measured in the temperature range from −20° to +60° C. The data obtained during these measurements show that the dielectric loss factors of the capacitors impregnated with the liquid compositions I and II is 30 to 40% lower than the loss factor of the capacitor steeped in component A.

In order to determine the dielectric loss factors of the liquid compositions I and II and the components A and B contained in them, 1 ppm of tricaprylmethylammonium chloride is added to each of the liquids in order to simulate an impurity. The dielectric loss factors of the liquids investigated with and without addition (doped and undoped) are collated in the table below.

| | tan δ (90° C., 50 Hz) | |
|---|---|---|
| Impregnating agent | undoped | doped |
| I | $10 \times 10^{-4}$ | $700 \times 10^{-4}$ |
| II | $10 \times 10^{-4}$ | $400 \times 10^{-4}$ |
| A | $10 \times 10^{-4}$ | $3300 \times 10^{-4}$ |
| B | $10 \times 10^{-4}$ | $20 \times 10^{-4}$ |

What is claimed is:

1. A liquid composition, having dielectric properties, which comprises a mixture of 85 to 60% by weight of ditolyl ether isomers, 15 to 40% by weight of an alkylbenzene and an acid acceptor.

2. The liquid composition of claim 1, which additionally contains an oxidation inhibitor.

3. The liquid composition of claim 2, which contains 2,6-di-tert.-butyl-4-methylphenol as the oxidation inhibitor.

4. The liquid composition of claim 1, wherein the acid acceptor is an epoxy compound.

5. The liquid composition of claim 2, which contains 90 to 110 parts by weight of the ditolyl ether/alkylbenzene mixture, 0.05 to 2.0 parts by weight of oxidation inhibitor and 0.05 to 2.0 parts by weight of acid acceptor.

6. The liquid composition of claim 5, which contains 2,2-bis-(4-hydroxyphenyl)-propanediglycidyl ether as epoxy compound and 2,6-di-tert.-butyl-4-methylphenol as oxidation inhibitor.

7. A liquid composition according to claim 4, wherein the epoxy compound is selected from the group consisting of 1,2-epoxy-3-phenoxypropane, bis-(3,4-epoxy-6-methylcyclohexyl-methyl) adipate, 1-epoxy-ethyl-3,4-epoxycyclohexane, 3,4-epoxy-cyclohexane, 3,4-epoxy-cyclohexylmethyl, 3,4-epoxycyclohexane-carboxylate, 3,4-epoxy-6-methyl-cyclohexylmethyl, 3,4-epoxy-6-methylcyclohexane-carboxylate and 2,2-bis-(4-hydroxyphenyl)-propane-diglycidyl ether.

8. A liquid composition according to claim 4, wherein the epoxy compound amounts to 0.1 to 5% by weight, relative to the total weight of the liquid.

9. A liquid composition according to claim 4, wherein the epoxy compound amounts to 0.3 to 1% by weight, relative to the total weight of the liquid.

10. A liquid composition according to claim 2, wherein the oxidation inhibitor amounts to 0.05 to 2% by weight, relative to the total weight of the liquid composition.

11. A liquid composition according to claim 2, wherein the oxidation inhibitor amounts to 0.1 to 1.0% by weight, relative to the total weight of the liquid composition.

12. A liquid composition according to claim 2, which contains 95 to 100 parts by weight of the ditolyl ether-/alkylbenzene mixture, 0.1 to 1 parts by weight of the acid acceptor and 0.1 to 1.0 parts by weight of the oxidation inhibitor.

13. A liquid composition according to claim 1, wherein the alkyl radical of the alkylbenzene contains 8 to 16 carbon atoms.

14. A liquid composition according to claim 1, wherein the alkyl radical of the alkylbenzene contains 10 to 14 carbon atoms.

15. A method for impregnating an electrical device comprising contacting the electrical device with an impregnating agent comprising a liquid composition according to claim 1.

* * * * *